US008903290B2

(12) United States Patent
Mikutsu

(10) Patent No.: US 8,903,290 B2
(45) Date of Patent: Dec. 2, 2014

(54) MEDIA STRIPPER MECHANISM

(71) Applicant: Yasunari Mikutsu, Tokyo (JP)

(72) Inventor: Yasunari Mikutsu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 139 days.

(21) Appl. No.: 13/664,649

(22) Filed: Oct. 31, 2012

(65) Prior Publication Data

US 2013/0121735 A1 May 16, 2013

(30) Foreign Application Priority Data

Nov. 14, 2011 (JP) ..... 2011-248572

(51) Int. Cl.
*G03G 15/20* (2006.01)

(52) U.S. Cl.
CPC ..... *G03G 15/2028* (2013.01); *G03G 15/2085* (2013.01)
USPC ..... 399/323

(58) Field of Classification Search
CPC ..... G03G 15/2085
USPC ..... 399/323, 322
See application file for complete search history.

(56) References Cited

U.S. PATENT DOCUMENTS 5,138,381 A * 8/1992 Masaki et al. ..... 399/159
5,617,197 A 4/1997 Kawabata et al.
7,890,039 B2 * 2/2011 Yamada ..... 399/323
2008/0107436 A1 5/2008 Mikutsu
2010/0239295 A1 9/2010 Mikutsu
2010/0303523 A1 12/2010 Yamada
2010/0310287 A1 12/2010 Mikutsu
2011/0091226 A1 4/2011 Ishigaya et al.
2011/0091244 A1 * 4/2011 Takigawa et al. ..... 399/167
2011/0164904 A1 * 7/2011 Hirose et al. ..... 399/323
2014/0050511 A1 * 2/2014 Mikutsu ..... 399/323

FOREIGN PATENT DOCUMENTS

EP 2 261 753 12/2010
GB 2296470 7/1996
JP 2006-133429 5/2006
JP 2006-133430 5/2006
JP 2006-189688 7/2006
JP 2006-313280 11/2006
JP 2008-052080 3/2008
JP 2009-031759 2/2009

OTHER PUBLICATIONS

European Search Report dated Mar. 6, 2013.

* cited by examiner

*Primary Examiner* — Walter L Lindsay, Jr.
*Assistant Examiner* — Rodney Bonnette
(74) *Attorney, Agent, or Firm* — Harness, Dickey & Pierce, P.L.C.

(57) ABSTRACT

A media stripper mechanism includes a stripping member. The stripping member has a stripping edge extending in an axial, longitudinal direction of the rotary member for contacting the recording medium upon exiting the nip, and a guide surface extending from the stripping edge for guiding the recording medium after stripping from the rotary member. The guide surface exhibits a maximum height roughness Rz of approximately 10 to 18 micrometers.

17 Claims, 4 Drawing Sheets

MEDIA STRIPPER MECHANISM

CROSS-REFERENCE TO RELATED APPLICATION

The present patent application claims priority pursuant to 35 U.S.C. §119 from Japanese Patent Application No. 2011-248572, filed on Nov. 14, 2011, which is hereby incorporated by reference herein in its entirety.

BACKGROUND OF THE INVENTION

1. Technical Field

The present invention relates to a media stripper mechanism, and more particularly, to a mechanism for stripping a recording medium from a rotary member, which may be employed in an electrophotographic image forming apparatus, such as a photocopier, facsimile machine, printer, plotter, or multifunctional machine.

2. Background Art

In electrophotographic image forming apparatuses, such as photocopiers, facsimile machines, printers, plotters, or multifunctional machines incorporating several of these imaging functions, an image is formed by attracting toner particles to a photoconductive surface for subsequent transfer to a recording medium such as a sheet of paper. After transfer, the imaging process may be followed by a fixing process using a fixing device, which permanently fixes the toner image in place on the recording medium by melting and setting the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip, through which a recording medium is passed to fix a toner image onto the medium under heat and pressure.

One important factor that determines imaging quality of a fixing device is the ability to convey a recording medium through the fixing nip without causing the recording medium to wind or wrap around the rotary fixing member. Media wraparound occurs where the toner image heated through the fixing nip becomes sticky and thus adheres to the surface of the fixing member upon exiting the fixing nip. If not corrected, a recording medium wrapping around the fixing member would cause jam or other conveyance failure in the fixing nip.

Several approaches have been employed to prevent toner adhesion to the fixing member and concomitant conveyance failures. Some use a special type of toner containing wax additives; others cover the surface of fixing roller or belt with a layer of non-stick, release material or with a coating of silicone oil or other suitable lubricant; and still others employ a media stripper that mechanically strips a recording medium from the fixing member. The media stripper mechanism, for example, may include one or more stripping fingers which defines a stripping edge that contacts the leading edge of the recording medium to strip it from the fixing member, as well as a guide surface along which the recording medium is guided after stripping from the fixing member.

One problem encountered when employing the media stripper mechanism in the fixing device is that forcing the recording medium with the stripping finger causes the guide surface of the stripping finger to interfere with the toner image printed on the recording medium. Not surprisingly, such interference would adversely affect imaging and conveyance performance of the fixing device, where the toner image, which is in a hot, molten state immediately after thermal fixing, is scratched by contacting the guide surface to form linear streaks on the resulting print, or otherwise, sticks to the guide surface to hinder proper conveyance of the recording medium.

The problem is particularly pronounced where printing is performed using coated paper, an increasingly popular type of recording medium typically formed of a paper substrate having a coating of resin on its surfaces. Because of the resin surface coating becoming soft when heated to a process temperature, the coated paper does not provide sufficient stiffness to counteract adhesion forces between the toner image and the fixing member at the exit of the fixing nip, resulting in an increased risk of the toner image to contact or stick to the guide surface.

Various methods have been proposed to provide an effective media stripper mechanism to prevent adverse effects due to interference between the recording medium and the stripping finger.

For example, one such method utilizes a plurality of stripping fingers having different configurations of the guide surface depending on the position at which each stripping finger is disposed in an axial, longitudinal direction of the fixing assembly. In this media stripper mechanism, the stripping finger positioned at a longitudinal end of the fixing member defines a relatively convex guide surface curving outward toward the media conveyance path whereas the stripping finger positioned at a longitudinal center of the fixing member defines a relatively concave guide surface curving inward away from the media conveyance path.

Although generally successful for its intended purpose, the method described above has several drawbacks. One drawback is that varying the configuration of the guide surface in the longitudinal direction results in a localized, concentrated pressure with which the recording medium is pressed against the stripping finger at the longitudinal end of the fixing member. Another drawback is that the guide surface can become irregular or uneven due to buildup of toner deposits resulting from repeated contact between the guide surface and the toner image on the recording medium being guided.

Concentrated pressure on the recording medium and increased irregularities of the guide surface both would adversely affect proper conveyance of the recording medium, or aggravate image defects due to contact between the toner image and the guide surface. These drawbacks make the media stripper mechanism less effective than would be desired, particularly where soft, coated paper is used.

SUMMARY OF THE INVENTION

Exemplary aspects of the present invention are put forward in view of the above-described circumstances, and provide a novel media stripper mechanism for stripping a recording medium from a rotary member disposed opposite another rotary member to form a nip therebetween.

In one exemplary embodiment, the media stripper mechanism includes a stripping member. The stripping member has a stripping edge extending in an axial, longitudinal direction of the rotary member for contacting the recording medium upon exiting the nip, and a guide surface extending from the stripping edge for guiding the recording medium after stripping from the rotary member. The guide surface exhibits a maximum height roughness Rz of approximately 10 to 18 micrometers.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
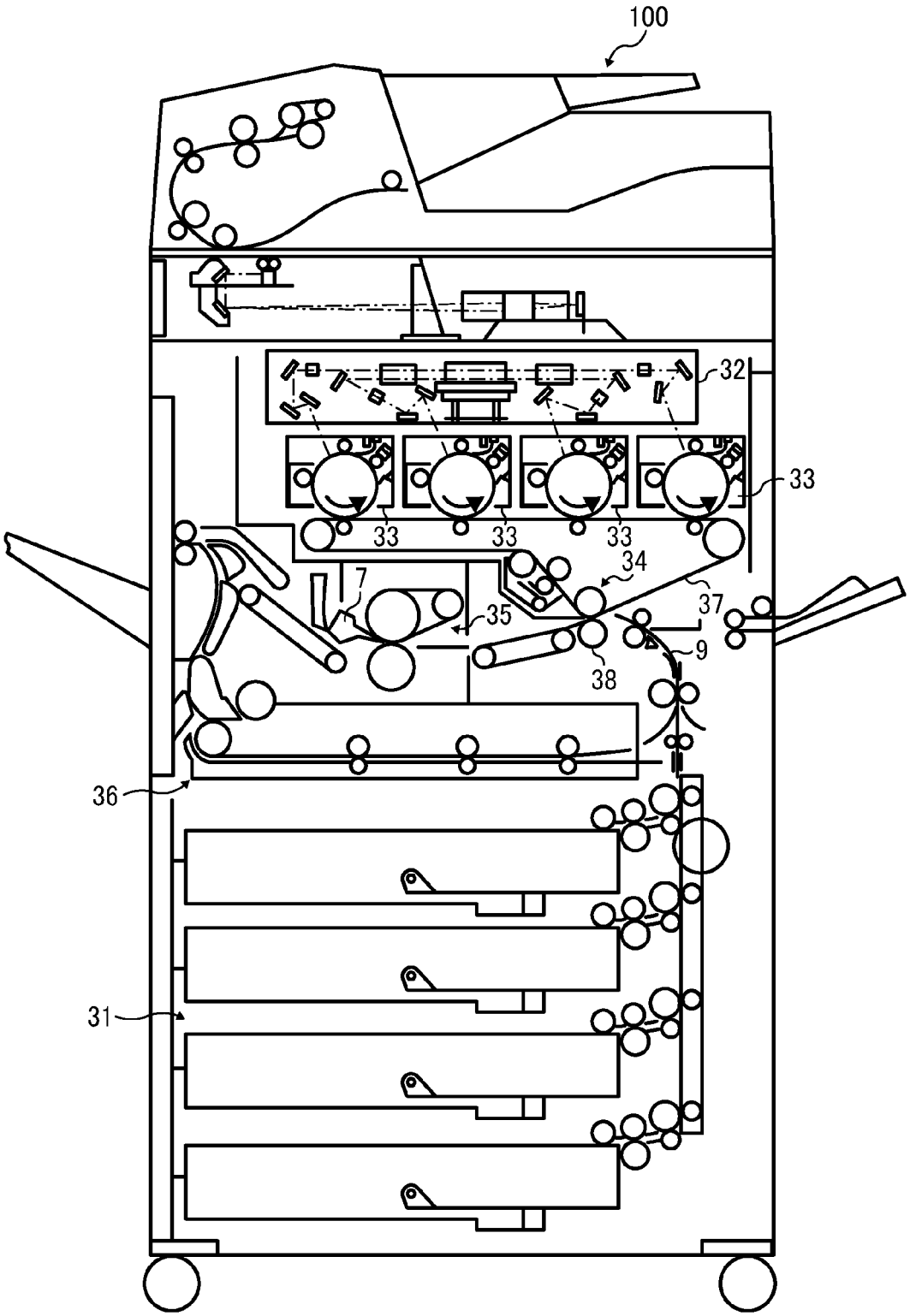
FIG. 1 schematically illustrates an image forming apparatus according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 according to one embodiment of this patent specification.

As shown in FIG. 1, the image forming apparatus 100 includes one or more imaging units 33 including a drum-shaped photoconductor surrounded by various pieces of imaging equipment, such as a charging device and a development device, which together form a toner image on the photoconductive surface with toner of a particular primary color.

Above the imaging units 33 is an exposure unit 32 including a light source for optically scanning the photoconductive surface. A sheet feed unit 31 is disposed at the bottom of the apparatus body, including one or more sheet trays accommodating a stack of recording media, such as sheets of paper 9.

Below the imaging units 33 extends a transfer device 34 that includes a looped, intermediate transfer belt 37 defining an outer, image bearing surface onto which the toner image is transferred from the photoconductive surface, and a transfer roller 38 disposed opposite the transfer belt 37 to define a transfer nip therebetween, through which the recording sheet 9 is conveyed as the rotary transfer members rotate together.

Adjacent to the transfer device 34, a fixing device 35 is disposed including a pair of opposed, rotary fixing members disposed opposite each other to define a fixing nip therebetween through which the recording sheet 9 is conveyed as the rotary fixing members rotate together. Optionally, a duplex unit 36 may be provided downstream from the fixing device 35, which includes a suitable conveyance mechanism that reverses the recording sheet 9 to reintroduce it into the transfer device 34 during duplex printing.

During operation, the exposure unit 32 irradiates the photoconductive surface with light according to image data transmitted from a suitable signal source, such as an external personal computer, or an image scanner that captures an image of an original document, to create an electrostatic latent image on the photoconductive surface, which is rendered into a visible, toner image by the development device. The toner image thus developed on the photoconductive surface is transferred onto the image bearing surface of the intermediate transfer belt 37.

Meanwhile, the sheet feed unit 31 supplies a recording sheet 9 to the transfer nip defined between the intermediate transfer belt 37 and the transfer roller 38. As the belt 37 rotates, the toner image enters the transfer nip, at which the toner image is transferred from the image bearing surface to the recording sheet 9. After image transfer, the recording sheet 9 then enters the fixing device 35, which fixes the powder toner image in place on the recording sheet 9 under heat and pressure.

Where duplex printing is intended, the recording sheet 9 is directed to the duplex unit 36, which reverses the incoming sheet 9 for reentry into the transfer nip and the fixing device 35. Thereafter, the recording sheet 9 is directed to an output tray outside the apparatus body, which completes one operational cycle of the image forming apparatus 100.

Basic features of electrophotographic image formation are well known in the art, and further description thereof is omitted herein.

According to this patent specification, the image forming apparatus 100 includes a sheet stripper mechanism 7 for stripping a recording sheet 9 from a rotary member, such as one included in the transfer device 34 and the fixing device 35, disposed opposite another rotary member to form a nip therebetween. A description is now given of the sheet stripper mechanism 7 according to one or more embodiments of this patent specification, with reference to FIG. 2 and subsequent drawings.

Figure 2:
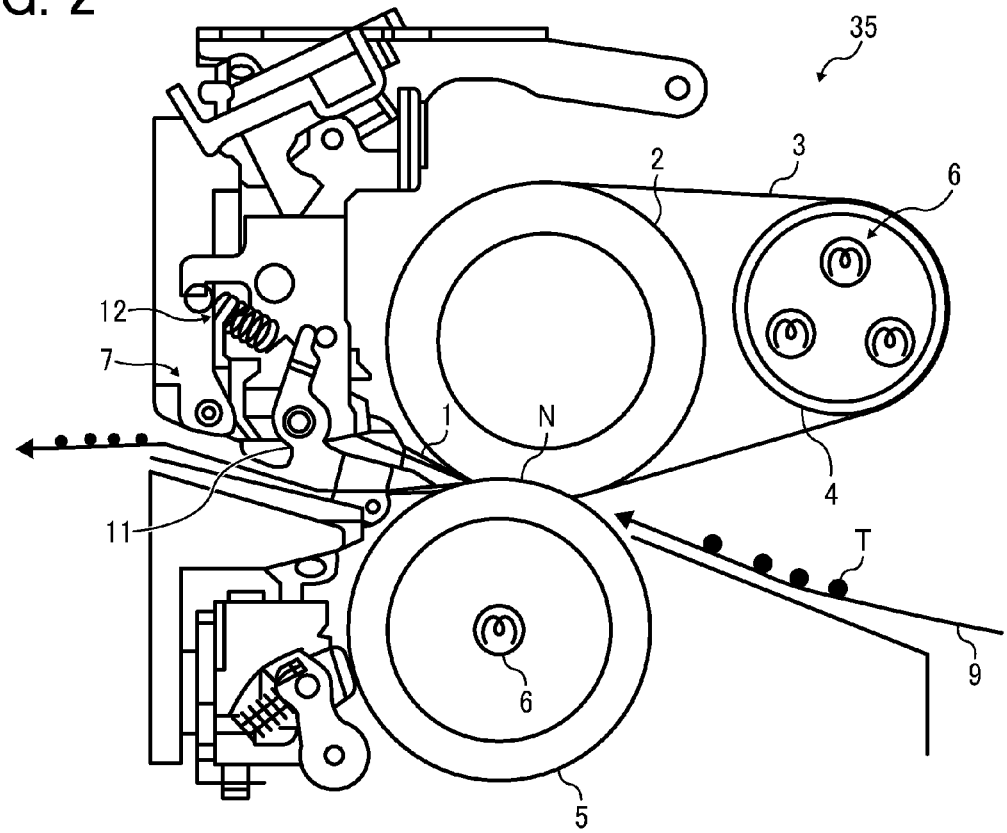
FIG. 2 is an end-on, axial view of a fixing device including a media stripper mechanism according to one embodiment of this patent specification.

FIG. 2 is an end-on, axial view of the fixing device 35 including the sheet stripper mechanism 7 according to one embodiment of this patent specification.

As shown in FIG. 2, the fixing device 35 includes a rotary fuser belt 3 entrained around a fuser roller 2 and a heat roller 4, as well as a rotary pressure roller 5 pressed against the fuser roller 2 through the fuser belt 3 to form a fixing nip N therebetween, all of which extend in an axial, longitudinal direction perpendicular to the sheet of paper on which the FIG. is drawn, as well as a heat source, such as one or more halogen heaters 6, disposed in each of the heat roller 4 and the pressure roller 5.

The sheet stripper mechanism 7 is disposed downstream from the fixing nip N to strip a recording sheet S from the fuser belt 3 upon exiting the fixing nip N, equipped with an operating lever 11, an extension spring 12, and other support and positioning members, which are assembled into a single unitary assembly for installation into the fixing device 35.

During operation, the fuser roller 2 rotates in a given direction of rotation (i.e., clockwise in FIG. 2) to rotate the fuser belt 3 in the same rotational direction, which in turn rotates the pressure roller 5 held in contact with the rotating belt 3. The fuser belt 3 during rotation has its circumference heated with the internally heated heat roller 4 to a given processing temperature sufficient for fusing toner at the fixing nip N.

In this state, a recording sheet 9 bearing an unfixed, powder toner image T enters the fixing device 35. As the rotary fixing members 3 and 5 rotate together, the recording sheet 9 passes through the fixing nip N, wherein heat from the fuser belt 3 causes toner particles to fuse and melt, while pressure between the belt 3 and the roller 5 causes the molten toner to settle onto the sheet surface, thereby fixing the toner image in place on the recording sheet 9.

At the exit of the fixing nip N, the sheet stripper mechanism 7 separates the recording sheet 9 from the fuser belt 3 to forward it to a post-fixing conveyance path defined, for example, between two guide plates, one on the side of the fuser belt 3 and one on the side of the pressure roller 5.

In the present embodiment, the fuser belt 3 comprises a looped, multi-layered flexible belt formed of a rigid substrate upon which an intermediate elastic layer and an outer layer of release agent are deposited one upon the other. For example, the fuser belt 3 may be shaped into a loop having an inner diameter of approximately 75 mm, formed of a substrate of polyimide resin approximately 90 μm thick, an intermediate layer of silicone rubber approximately 200 μm thick, and an outer coating of tetrafluoroethylene-perfluoroalkoxy vinyl ether copolymer or PFA approximately 20 μm thick.

The fuser roller 2 comprises a rotatable cylinder having an outer surface formed of elastic material. For example, the fuser roller 2 may be a compliant roller having an outer diameter of approximately 52 mm, formed of an elastic layer of sponged silicone rubber approximately 14 mm in thickness.

The heat roller 4 comprises a hollow cylinder formed of thermally conductive material. The heat roller 4 may be a tubular body of aluminum having a wall thickness of 0.6 mm and an outer diameter of approximately 35 mm.

The pressure roller 5 comprises a rotatable cylinder consisting of a hollow, rotatable cylindrical core covered by an elastic layer of silicone rubber or the like deposited thereupon, equipped with a suitable biasing mechanism that presses the pressure roller 5 against the fuser roller 2. For example, the pressure roller 5 may be a compliant roller having an outer diameter of approximately 50 mm, formed of a hollow cylindrical core of steel approximately 1 mm thick, which is covered by an inner layer of silicone rubber approximately 1.5 mm thick and an outer layer of PFA provided in the form of a tubular cover fitted around the cylindrical core.

The pressure roller 5 is intruded to a depth of approximately 3 mm into the fuser roller 2, yielding an area of contact between the pressure roller 5 and the fuser roller 3 approximately 14 mm in a direction in which the recording sheet 9 is conveyed through the fixing nip N.

Figure 3:
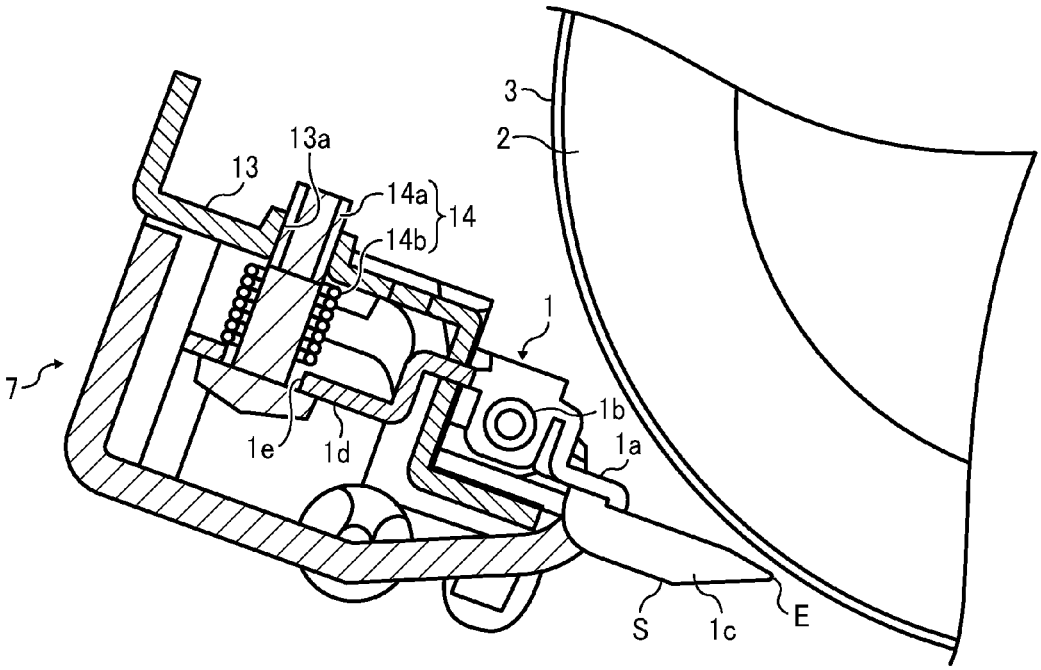
FIG. 3 is an enlarged, partial sectional side elevation view of a portion encircled by broken line in FIG. 2.

FIG. 3 is an enlarged, partial sectional side elevation view of a portion encircled by broken line in FIG. 2.

As shown in FIG. 3, the sheet stripper mechanism 7 includes a stripping member 1 having a stripping edge E extending in the axial, longitudinal direction of the rotary fixing member 3 for contacting the recording medium 9 upon exiting the nip N, and a guide surface S extending from the stripping edge E for guiding the recording medium 9 after stripping from the rotary fixing member 3.

One problem encountered when employing the media stripper mechanism in the fixing device is that forcing the recording medium with the stripping finger causes the guide surface of the stripping finger to interfere with the toner image printed on the recording medium. Not surprisingly, such interference would adversely affect imaging and conveyance performance of the fixing device, where the toner image, which is in a hot, molten state immediately after thermal fixing, is scratched by contacting the guide surface to form linear streaks on the resulting print, or otherwise, sticks to the guide surface to hinder proper conveyance of the recording medium.

The problem is particularly pronounced where printing is performed using coated paper, an increasingly popular type of recording medium typically formed of a paper substrate having a coating of resin on its surfaces. Because of the resin surface coating becoming soft when heated to a process temperature, the coated paper does not provide sufficient stiffness to counteract adhesion forces between the toner image and the fixing member at the exit of the fixing nip, resulting in an increased risk of the toner image to contact or stick to the guide surface.

The inventor has recognized that the degrees of image defects and conveyance failures caused by interference between the stripping finger and the recording medium vary depending on surface roughness of the guide surface of the stripping finger. The rougher the guide surface, the more likely the toner image is to be scratched by contacting the guide surface to form linear streaks on the resulting print; the smoother the guide surface, the more likely the toner image is to stick to the guide surface to hinder proper conveyance of the recording medium.

According to this patent specification, the sheet stripper mechanism 7 includes the stripping member 1 having the guide surface S that exhibits a maximum height roughness Rz of approximately 10 to 18 micrometers (μm). Provision of the guide surface S with the specific range of surface roughness prevents undue interference of the guide surface S with the toner image printed on the recording medium 9, which would otherwise result in adverse effect in imaging and conveyance performance of the rotary members.

As used herein, the term "surface roughness" or maximum height roughness Rz of the guide surface refers to a measure of maximum peak-to-valley amplitude of a roughness profile within a given sampling length, as prescribed by the Japanese Industrial Standard (JISB0601: 2001). Such a roughness parameter may be measured using a commercially available measurement device, for example, contact-type surface roughness tester, model Formtracer SV-C500, manufactured by Mitutoyo Corp.

Specifically, in the present embodiment, the sheet stripper mechanism 7 includes a plurality of stripping fingers 1, of which only one is visible in FIG. 3, arranged in the axial, longitudinal direction in which the fuser roller 2 and the pressure roller 5 extend parallel to each other. The stripping fingers 1 are disposed across a maximum compatible width of recording medium accommodated in the fixing nip N in the axial direction of the rotary fixing member 2.

Alternatively, instead of multiple stripping fingers, the stripping member 1 may be configured as a single elongated stripping plate extending in the axial direction of the rotary fixing member 2. In such cases, the stripping plate encompasses a maximum compatible width of recording medium accommodated in the fixing nip N in the axial direction of the rotary fixing member 2.

Figure 4A:
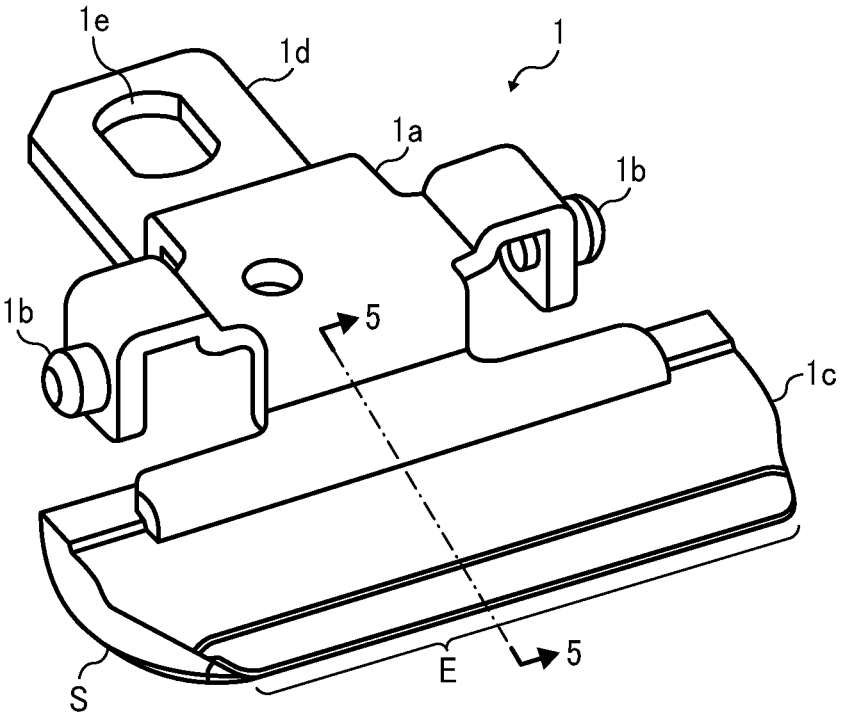
FIG. 4A is a perspective view of a stripping finger before assembly into the media stripper mechanism of FIG. 2.
Figure 4B:
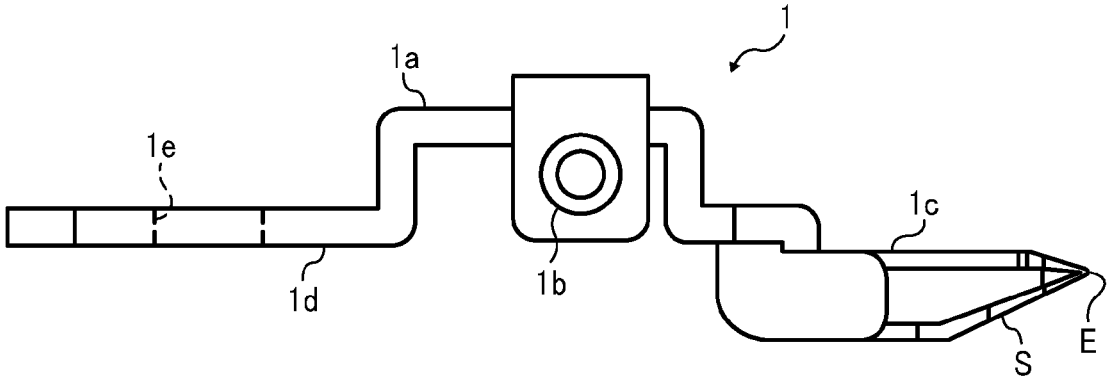
FIG. 4B is a side elevational view of a stripping finger before assembly into the media stripper mechanism of FIG. 2.

With additional reference to FIGS. 4A and 4B, which are perspective and side elevational views, respectively, of the stripping finger 1 before assembly, the stripping finger 1 is shown formed of a base member 1*a* having a pair of pivot pins 1*b* on opposite sides thereof to define a rotational axis around which the stripping finger is freely rotatable. At one, free end of the stripping finger 1 is a finger tip 1*c* affixed to the base member 1*a* to form the stripping edge E for contacting the recording medium 9 upon exiting the fixing nip N as well as the guide surface S for guiding the recording medium 9 after stripping from the rotary fixing member 3. At another, fixed end of the stripping finger 1 is a mounting flange 1*d* extending from the base member 1*a* and having a through-hole 1*e* defined therein.

Figure 5:
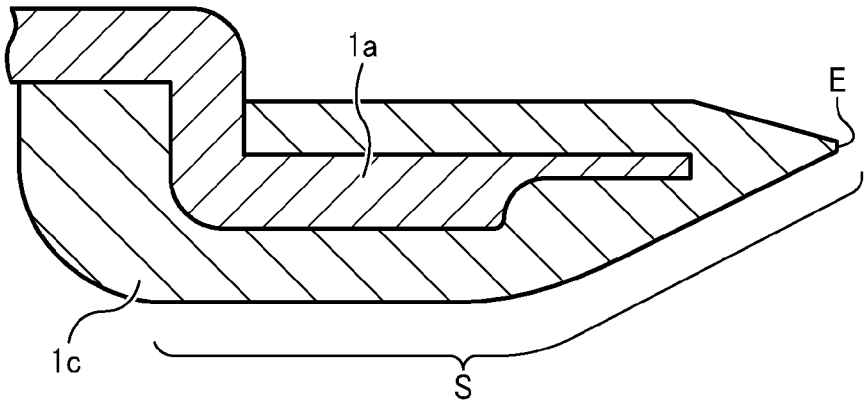
FIG. 5 is a partial cross-sectional view of the stripping finger along lines 5-5 of FIG. 4A.

FIG. 5 is a partial cross-sectional view of the stripping finger 1 along lines 5-5 of FIG. 4A.

As shown in FIG. 5, in the present embodiment, the base member 1*a* and the finger tip 1*c* comprise separate parts of elastic materials, such as resins or plastics with different hardness values, which are combined together, for example, by insert molding into a single, integral component in the shape of a fingernail with a tapered cross section. The finger tip 1*c* is formed of an elastic material softer than that of which the base member 1*a* is formed, and processed through a suitable technique to form the guide surface S with a maximum height roughness ranging from approximately 10 to 18 μm.

For example, the finger tip 1*c* may be a molded piece of fluorine resin. In such cases, the mold used to shape the finger tip 1*c* is suitably designed, or the surface of molded plastic is polished through finishing process, such that the resulting material exhibits the specific range of surface roughness.

Alternatively, instead, the finger tip 1*c* may be a molded piece of resin, such as polyether ether ketone (PEEK), polyamide-imide (PAI), or polyimide (PI), at least part of which is covered with a coating of fluorine resin to form the guide surface S. In such cases, the mold used to shape the finger tip 1*c* is suitably designed, or the surface of molded plastic is polished through finishing process, such that the resulting material, after being covered with a coating of fluorine resin, exhibits the specific range of surface roughness. Instead of roughening the mold or the molded plastic, modifying the coating process to produce a rough-coated surface is also possible.

In such a configuration, the integrally molded, elastic finger-shaped stripping member 1 is highly resistant to permanent set or fatigue due to external stresses experienced, for example, upon jamming of a recording medium at the fixing nip N. Further, forming the finger tip 1*c* with a relatively soft pliant material prevents damage to surrounding structure upon installation into the fixing device 35.

Moreover, use of insert molding to obtain the composite stripping finger 1 allows for precise fitting of the separate elastic parts, which in turn allows for precise alignment of the finger edge with the rotational axis defined by the pivot pins 1*b*, comparable to that possible where the entire structure of stripping finger 1 is formed of a single, uniform material.

Furthermore, owing to its excellent slidability and good release from adhesive materials, use of fluororesin material prevents the finger tip 1*c* from damaging the adjoining surfaces and soiling with adhesive toner during operation. Forming the finger tip 1*c* entirely of fluorine resin is superior in terms of durability against wear and tear due to abrasion, whereas providing the finger tip 1*c* with a coating of fluorine resin allows for higher flexibility in adjusting surface properties of the guide surface S.

Referring back to FIG. 3, the sheet stripper mechanism 7 is shown further including a mount 13 on which the plurality of stripping fingers 1 is supported, and a position adjuster 14 connected with each of the plurality of stripping fingers 1 to position the stripping edge thereof with respect to the rotary member.

In the present embodiment, the mount 13 comprises an elongated member extending in the axial direction and having a plurality of screw holes 13*a* defined therein, of which only one is visible in FIG. 3. The position adjuster 14 includes a combination of a screw 14*a* disposed between the mount 13 and each stripping finger 1 and a compression spring 14*b* disposed around the screw shank.

During assembly, the mount 13 is secured to a suitable support of the fixing device 35. The stripping finger 1 is placed on the mount 13 such that the through-hole 1*e* of the mounting flange 1*d* aligns with the screw hole 13*a* of the mount 13. The adjuster screw 14*a* is inserted through the aligned holes 1*e* and 13*a* with the compression spring 14*b* interposed between the mount 13 and the mounting flange 1*d*.

In such a configuration, turning the adjuster screw 14*a* causes the stripping finger 1 to rotate around the rotational axis defined by the pivot pin 1*b* to allow positioning of the stripping edge E with respect to the rotary fixing member 3. For example, tightening the screw 14*a* causes the stripper finger 1 to rotate away from the fuser belt 3, resulting in a wider gap between the stripping edge E and the belt surface. Contrarily, loosening the screw 14*a* causes the stripper finger 1 to rotate toward the fuser belt 3, resulting in a narrower gap between the stripping edge E and the belt surface.

The gap or spacing between the stripper edge E and the surface of the fuser belt 3 may be adjusted depending on specific application. For example, direct contact between the stripping edge E and the belt surface allows the finger tip 1*c* to securely catch the recording sheet 9 exiting from the fixing nip N, leading to effective, reliable performance of the stripper mechanism 7. Providing a small gap, for example, in a range of 0.1 to 0.6 mm, between the stripper edge E and the belt surface, on the other hand, prevents damage to the fuser belt 3 due to sliding against the finger tip 1*c*, leading to longer life of the belt assembly without substantial loss of stripping performance.

Experiments have been conducted to investigate efficacy of the media stripper mechanism according to this patent specification.

In the experiments, four test devices, similar to that depicted primarily with reference to FIG. 2, were prepared, each including a seven-fingered sheet stripper mechanism with different configurations of the guide surface of the stripping finger: device A with a surface roughness of 7 μm; device B with a surface roughness of 10 μm; device C with a surface roughness of 18 μm; and device D with a surface roughness of 22 μm. The specific values of surface roughness were measured using a contact-type surface roughness tester, model Formtracer SV-0500, manufactured by Mitutoyo Corp.

Printing was performed to produce solid color images on thin, coated copy paper having a basis weight of 79 g/m$^2$. The test devices were operated at a temperature of 27° C. and a humidity of 80%, that is, high-temperature, high-humidity conditions under which printing is most susceptible to image defects and conveyance failures.

Evaluations were carried out to determine imaging and conveyance performance at the first pass since activation during which temperature is most unstable in the fixing device. Imaging performance was evaluated through visual inspection of the resulting print to detect presence of defects caused where the toner image is scratched by contacting the stripping finger to leave linear streaks on the resulting print. Conveyance performance was evaluated in terms of immunity from conveyance failures in which the toner image sticks to the guide surface to disturb, either temporarily or permanently, smooth conveyance of the recording medium, resulting in tracks of the finger tips on the printed surface or eventual jam of the recording medium.

Results of the experiments are provided in Table 1 below.

TABLE 1

| Device | Surface roughness Rz | Image defects | Conveyance failures |
|---|---|---|---|
| A | 7 μm | Unobserved | Observed |
| B | 10 μm | Unobserved | Unobserved |
| C | 18 μm | Unobserved | Unobserved |
| D | 22 μm | Observed | Unobserved |

As shown in Table 1, of the four test devices used in the experiments, the device D with the highest surface roughness of 22 μm created a defective image with noticeable linear streaks, whereas the other three test devices A, B, and C with relatively low surface roughness values were completely free of such image defects. In addition, of the four test devices used in the experiments, conveyance failures took place only in the device A with the lowest surface roughness of 7 μm, whereas the three test devices B, C, and D with relatively high surface roughness values could properly convey the recording medium.

The experimental results demonstrate efficacy of setting the surface roughness of the guide surface in the range of approximately 10 to 18 μm. Considering that printing was performed under the hot and humid, most error-prone conditions in the experiments, the media stripper mechanism with the specific range of surface roughness according to this patent specification is practically immune to any image defects and conveyance failures caused by interference between the stripping finger and the recording medium.

To recapitulate, the media stripper mechanism 7 according to this patent specification can effectively strip a recording medium 9 from a rotary member 3 disposed opposite another rotary member 5 to form a nip N therebetween. The mechanism 7 includes a stripping member 1 having a stripping edge E extending in an axial, longitudinal direction of the rotary member 5 for contacting the recording medium 9 upon exiting the nip N, and a guide surface S extending from the stripping edge E for guiding the recording medium 9 after stripping from the rotary member 1. The guide surface S exhibits a maximum height roughness of approximately 10 to 18 micrometers.

Provision of the guide surface S with the specific range of surface roughness prevents undue interference of the guide surface S with the toner image printed on the recording medium 9 which would otherwise result in adverse effect in imaging and conveyance performance of the rotary members.

Although in several embodiments depicted above, the media stripper mechanism 7 is described as being used with the rotary fuser belt 3 included in the fixing device 35, the mechanism 7 according to this patent specification finds applications other than those described herein.

For example, the mechanism 7 may be used with any type of rotary fixing member in the shape of a roller, an endless belt, or the like, for fixing a toner image in place on the recording medium. Further, the mechanism 7 may be used with any type of rotary transfer member in the shape of a roller, an endless belt, or the like, for transferring a toner image onto the recording medium from an image bearing surface. Moreover, the mechanism 7 may be used with any type of rotary member in the shape of a roller, an endless belt, or the like, included in an electrophotographic image forming apparatus, such as a photocopier, a printer, a plotter, a facsimile, or a multifunctional machine incorporating several of such imaging functions.

Numerous additional modifications and variations are possible in light of the above teachings. It is therefore to be understood that, within the scope of the appended claims, the disclosure of this patent specification may be practiced otherwise than as specifically described herein.

What is claimed is:

1. A media stripper mechanism for stripping a recording medium from a rotary member disposed opposite another rotary member to form a nip therebetween, the mechanism comprising:

a stripping member having a stripping edge extending in an axial, longitudinal direction of the rotary member for contacting the recording medium upon exiting the nip, and a guide surface extending from the stripping edge for guiding the recording medium after stripping from the rotary member, the guide surface exhibiting a maximum height roughness Rz of approximately 10 to 18 micrometers.

2. The mechanism according to claim 1, wherein the stripping edge contacts the rotary member.

3. The mechanism according to claim 1, wherein the stripping edge is spaced apart from the rotary member.

4. The mechanism according to claim 1, further comprising a position adjuster connected with the stripping member to position the stripping edge thereof with respect to the rotary member.

5. The mechanism according to claim 1, wherein the stripping member comprises a plurality of stripping fingers arranged in the axial direction of the rotary member.

6. The mechanism according to claim 5, wherein each stripping finger comprises:

a base member having a rotational axis around which the stripping finger is freely rotatable; and a finger tip connected to the base member to form the stripping edge for contacting the recording medium upon exiting the nip.

7. The mechanism according to claim 6, further comprising:

a mount on which the plurality of stripping fingers is supported;

a screw disposed between the mount and each stripping finger; and a compression spring disposed around the screw shank, wherein turning the screw causes the stripping finger to rotate around the rotational axis to allow positioning of the stripping edge with respect to the rotary member.

8. The mechanism according to claim 6, wherein the base member and the finger tip comprise separate parts of elastic materials combined together by insert molding into a single, integral component in the shape of a fingernail with a tapered cross section.

9. The mechanism according to claim 1, wherein the stripping member comprises an elongated stripping plate extending in the axial direction of the rotary member.

10. The mechanism according to claim 1, wherein the stripping member extends across a maximum compatible width of recording medium accommodated in the nip in the axial direction of the rotary member.

11. The mechanism according to claim 1, wherein the stripping member is a molded piece of fluorine resin.

12. The mechanism according to claim 1, wherein the stripping member is a molded piece of material selected from the group consisting of polyether ether ketone, polyamide-imide, polyimide, and combinations thereof, at least part of the molded piece being covered with a coating of fluorine resin.

13. The mechanism according to claim 1, wherein the rotary member comprises a rotary fixing member for fixing a toner image in place on the recording medium.

14. The mechanism according to claim 1, wherein the rotary member comprises a rotary transfer member for transferring a toner image onto the recording medium from an image bearing surface.

15. An image forming apparatus employing the mechanism according to claim 1.

16. A media stripper mechanism for stripping a recording medium from a rotary member, the mechanism comprising:

a stripping member having a stripping edge extending in an axial, longitudinal direction of the rotary member for contacting the recording medium, and a guide surface extending from the stripping edge for guiding the recording medium after stripping, the guide surface exhibiting a maximum height roughness Rz of approximately 10 to 18 micrometers.

17. An image forming apparatus employing the mechanism according to claim 16.

* * * * *